US009989049B2

(12) United States Patent
Bergstedt

(10) Patent No.: US 9,989,049 B2
(45) Date of Patent: Jun. 5, 2018

(54) MICROFLUIDIC PUMP

(71) Applicant: Funai Electric Co., Ltd., Daito (JP)

(72) Inventor: Steven W. Bergstedt, Winchester, KY (US)

(73) Assignee: Funai Electric Co., Ltd. (JP)

( * ) Notice: Subject to any disclaimer, the term of this patent is extended or adjusted under 35 U.S.C. 154(b) by 342 days.

(21) Appl. No.: 14/966,194

(22) Filed: Dec. 11, 2015

(65) Prior Publication Data

US 2017/0167481 A1 Jun. 15, 2017

(51) Int. Cl.
*F04B 49/06* (2006.01)
*F04B 19/00* (2006.01)

(52) U.S. Cl.
CPC ..... *F04B 49/065* (2013.01); *F04B 19/006* (2013.01)

(58) Field of Classification Search
None
See application file for complete search history.

(56) References Cited

U.S. PATENT DOCUMENTS 6,273,687 B1 8/2001 Nogimori et al.
7,118,351 B2 10/2006 Effenhauser et al.
7,213,473 B2 * 5/2007 Mosier ..... B01L 3/0293 73/861.52
7,445,926 B2 * 11/2008 Mathies ..... B01F 5/10 137/833
7,453,187 B2 11/2008 Richards et al.
7,455,770 B2 * 11/2008 Gilbert ..... B01L 3/502707 204/450
7,611,673 B2 * 11/2009 Kartalov ..... B01L 3/50273 422/502
7,672,059 B2 * 3/2010 Batchko ..... G02B 3/14 359/665
7,727,363 B2 * 6/2010 Jacobson ..... C07K 1/24 137/13
7,741,130 B2 * 6/2010 Lee, Jr. ..... B01D 61/08 436/180

(Continued)

FOREIGN PATENT DOCUMENTS

JP 02275067 A1 11/1990
JP 2003260795 A1 9/2003

*Primary Examiner* — Michael Lebentritt
(74) *Attorney, Agent, or Firm* — Luedeka Neely Group, PC

(57) ABSTRACT

A microfluidic pump on a monolithic chip. A closed length of channel is disposed on the chip, with a plurality of energizers disposed along the length of the channel. Each energizer is associated with a unique energizer designation. An onboard controller and energizer fire control lines are also disposed on the chip. One each of the energizer fire control lines is electrically connecting one each of the energizers to the onboard controller. Inputs are electrically connected to the onboard controller, for connecting the onboard controller to an external controller that is not disposed on the chip. The inputs include a power input, a ground input, and an enable input. The onboard controller has circuitry to (a) receive from the external controller an enable on the enable input, (b) send a timed sequence of fire commands on the energizer fire control lines to a selected number of energizers that is greater than one, starting with a stored starting energizer and ending with an ending energizer, and (c) update the stored starting energizer with the designation for the energizer next following the ending energizer.

18 Claims, 5 Drawing Sheets

(56) References Cited

U.S. PATENT DOCUMENTS

| | | | | |
|---|---|---|---|---|
| 7,766,033 | B2 * | 8/2010 | Mathies | F16K 99/0001 137/297 |
| 7,790,118 | B2 * | 9/2010 | Maltezos | B01L 3/502707 137/833 |
| 7,896,621 | B2 | 3/2011 | Park et al. | |
| 8,137,626 | B2 * | 3/2012 | Maltezos | G01N 21/6452 422/82.07 |
| 8,220,493 | B2 * | 7/2012 | Easley | B01L 3/502746 137/829 |
| 8,480,974 | B2 * | 7/2013 | Rapp | B01L 3/502715 422/502 |
| 8,891,949 | B2 | 11/2014 | Hong et al. | |
| 9,170,028 | B1 * | 10/2015 | Beer | B01L 7/52 |
| 9,322,014 | B1 * | 4/2016 | VanderNoot | C12N 15/101 |
| 9,395,050 | B2 * | 7/2016 | Kornilovich | F17D 3/00 |
| 9,528,503 | B2 * | 12/2016 | Daidzic | B23P 15/26 |
| 9,546,932 | B2 * | 1/2017 | Putnam | B01J 19/0046 |
| 9,562,914 | B2 * | 2/2017 | Jain | G01N 33/4905 |
| 9,566,581 | B2 * | 2/2017 | Imran | B01J 19/0093 |
| 9,579,652 | B2 * | 2/2017 | Asai | B01L 3/50273 |
| 9,651,568 | B2 * | 5/2017 | Putnam | G01N 35/00029 |
| 9,700,889 | B2 * | 7/2017 | Putnam | B01L 3/502707 |
| 9,725,687 | B2 * | 8/2017 | Wikswo | C12M 23/16 |
| 9,770,055 | B2 * | 9/2017 | Cameron | A24F 47/008 |
| 2007/0132327 | A1 | 6/2007 | Brunet | |
| 2010/0165784 | A1 * | 7/2010 | Jovanovich | B01F 11/0045 366/163.2 |
| 2011/0126910 | A1 * | 6/2011 | May | B01F 13/0059 137/1 |
| 2013/0202453 | A1 | 8/2013 | Hong et al. | |
| 2015/0037175 | A1 | 2/2015 | Guan et al. | |
| 2016/0208833 | A1 * | 7/2016 | Hui | F16K 99/0001 |

* cited by examiner

100

MICROFLUIDIC PUMP

FIELD

This invention relates to the field of fluid pumps. More particularly, this invention relates to a microfluidic pump with a simplified electronic control interface.

INTRODUCTION

Microfluidic pumps are tiny devices that are manufactured using microelectronic device fabrication technologies, such as photolithographic patterning, wet and dry etching techniques, and thin film deposition processes. Thus, these devices are extremely small, and operate on very small volumes of fluid. As such, they are ideal for applications where a small device is required and small amounts of fluid are to be dispensed.

One type of microfluidic pump operates by expanding a bubble of the fluid within a channel, and then moving the bubble along the channel in one direction or the other, such that the bubble pushes the downstream volume of fluid along the channel in front of it, and pulls the upstream volume of fluid through the channel behind it.

To move the bubble within the channel, the pump is constructed with a plurality of devices disposed along the length of the channel, which devices are operable to at least one of create and maintain the bubble of fluid. These devices are typically operated in a timed, serial manner in one direction or the other along the length of the channel, and thus move the bubble as desired through the channel.

Unfortunately, while the devices themselves can be made very small, the circuitry required to connect the pump to a controller is typically comparatively bulky, as a control line for each one of devices along the channel length is typically required. The additional size of the overall pump device that is required at least in part by the control lines tends to prevent the adoption and use of microfluidic pumps such as these in applications where their size is a critical factor.

What is needed, therefore, is a microfluidic pump that reduces issues such as those described above, at least in part.

SUMMARY OF THE CLAIMS

The above and other needs are met by a microfluidic pump on a monolithic chip. A closed length of channel is disposed on the chip, with a first open end and a second open end. A plurality of energizers are disposed along the length of the channel, where each energizer is associated with a unique energizer designation. An onboard controller and energizer fire control lines are also disposed on the chip. One each of the energizer fire control lines is electrically connecting one each of the energizers to the onboard controller. Inputs are electrically connected to the onboard controller, for connecting the onboard controller to an external controller that is not disposed on the chip. The inputs include a power input, a ground input, and an enable input. The onboard controller has circuitry to (a) receive from the external controller an enable on the enable input, (b) send a timed sequence of fire commands on the energizer fire control lines to a selected number of energizers that is greater than one, starting with a stored starting energizer and ending with an ending energizer, and (c) update the stored starting energizer with the designation for the energizer next following the ending energizer.

According to another aspect of the invention there is described a microfluidic pump on a monolithic chip, having a closed length of channel disposed on the chip, where the channel has a first open end and a second open end. Heaters are disposed along the length of the channel, where each heater is associated with a unique heater designation. An onboard controller and heater fire control lines are also disposed on the chip, one each of the heater fire control lines electrically connecting one each of the heaters to the onboard controller. Inputs are electrically connected to the onboard controller, and connect the onboard controller to an external controller that is not disposed on the chip. The inputs include a power input, an enable input, a pump direction input, and a heater run length input. The onboard controller has circuitry to (a) receive from the external controller and selectively retain a pump direction on the pump direction input, (b) receive from the external controller and selectively retain a heater run length on the heater run length input, where the energizer run length is equal to 8x, where x is an integer from 1 to 4, (c) receive from the external controller an enable on the enable input, (d) send a timed sequence of fire commands on the heater fire control lines to a selected number of heaters that is equal to the heater run length, starting with a stored starting heater and ending with an ending heater, and (e) update the stored starting heater with the designation for the heater next following the ending heater.

In specific embodiments of the various aspects of the invention, the energizers are heaters or piezoelectric devices. In some embodiments the energizer run length is an integer between 1 and 32. In some embodiments the energizer run length is equal to 8x, where x is an integer from 1 to 4. In some embodiments the timed sequence is a set time between each fire command, or is a variable time between each fire command, or is a selectable time between each fire command.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Overview

A self-firing and cycling microfluidic pump according to and embodiment of the present invention is started and stopped with a single electrical signal. The pump features an internal oscillator and fire duty cycle selection options for the generated fire signal. The rank or order of the pump (the number of heaters in a single cycle of the pump) can be selected, as well as the direction of the pumping sequence. The internal voltage controlled oscillator (VCO) is tunable with an input voltage.

Some embodiments of the pump only require three pins; a power, a ground, and an enable. The pump's internal sequencer selects the next firing heater using its internal sequencer. The on-chip VCO is used to generate the fire signal with a default that is sufficient to pump the fluid.

Figure 1:
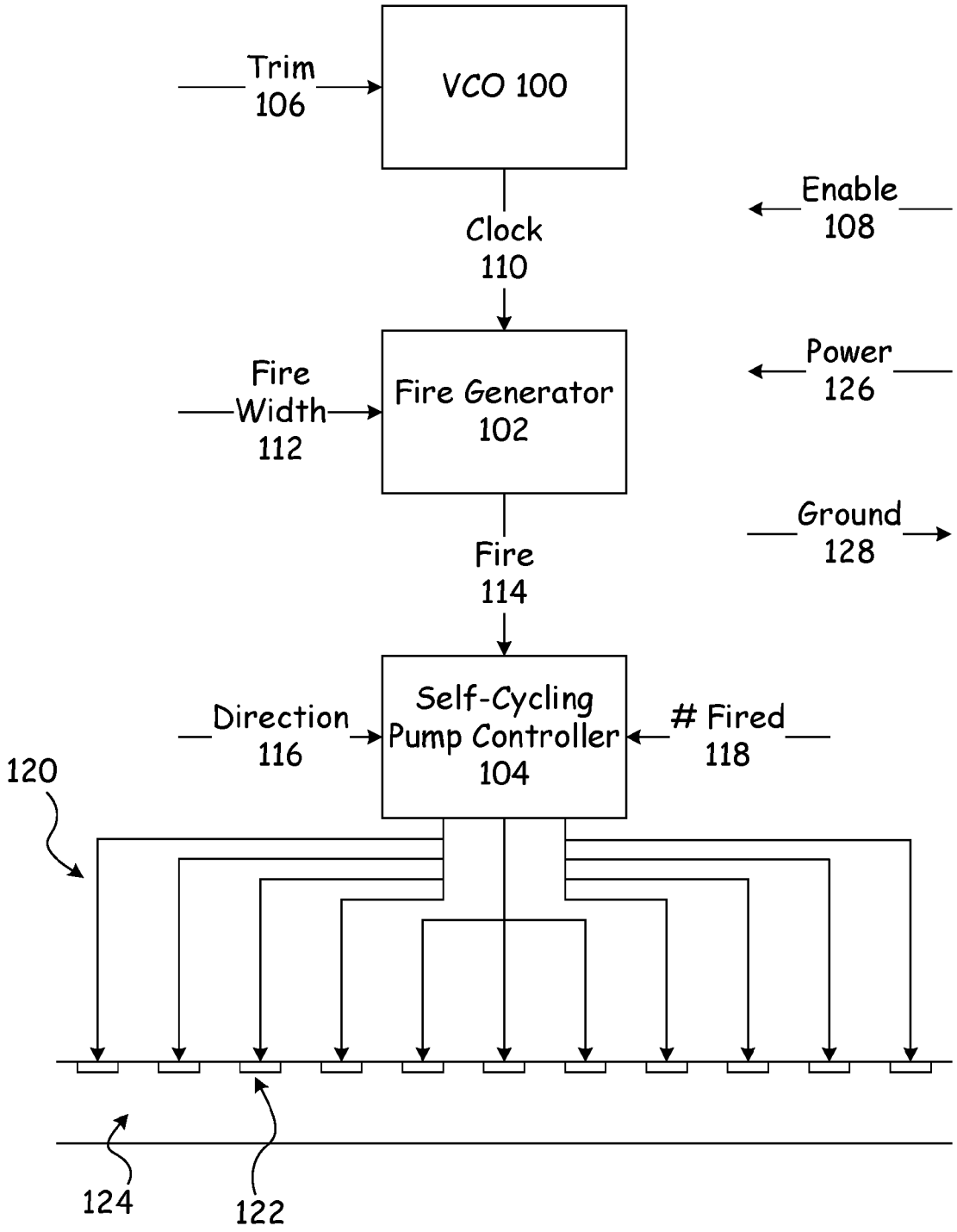
FIG. 1 is a structural block diagram of a microfluidic pump according to an embodiment of the present invention.

With reference now to FIG. 1, there is depicted a structural block diagram of a microfluidic pump system 10 according to an embodiment of the present invention. It is appreciated that not all of the elements as depicted in the figures are present in all embodiment of the present invention, and that the specific elements as described herein may vary in different embodiments. Thus, the description provided below is in regard to the depicted embodiment, and not all embodiments.

The pump 10 includes a VCO 100, which produces a clock signal on line 110 for generating the pump firing signals and sequencing the state machine controlling the firing order. In some embodiments, the VCO 100 receives an input 106 of a trim voltage for the VCO 100 frequency, and an enable 108 that turns the VCO clock on and off to enable/disable pump firing. When the VCO 100 is on (enable 108 is high), the pump 10 fires in a cycle sequence, and when the VCO 100 is off (enable 108 is low), the pump 10 stops firing.

The clock signal 110 is received by a fire signal generator 102, which produces as an output a fire signal 114 of a precise time width that is applied to the pump 122 selected in the state machine, as described in more detail hereafter. The fire signal generator 102 receives as an input a fire width 112, which is measured in a number of clock cycles as received on the clock line 110, and controls the fire signal 114 width. The fire width 112 determines the length of the fire signal 114, such as three clock pulses or nine clock pulses, or anything in-between as desired (for example). The fire signal generator 102, in some embodiments, has a default fire signal 114 width, and does not need an input 112 for a selectable fire width.

The fire signal 114 is received as an input by the self-cycling pump control circuit 104, which controls the energizers 122 that are fired in sequence. Receipt of a fire signal 114 causes the pump control 104 to initiate a firing sequence, or in other words, initiate sending power signals on lines 120 to the energizers 122 that are disposed in the channel structure 124 of the pump 10. In some embodiments the pump controller 104 receives as an input a direction signal 116. For example, in one embodiments a low state on the input 116 allows the pump controller 104 to fire the energizers 122 in what could be called a forward or normal direction. On the other hand, a high state on the input 116 causes the pump controller 104 to fire the energizers 122 in a reverse sequential order.

In some embodiments the pump controller 104 also receives as input the length or rank of the pump sequence 118, or in other words the number of energizers 122 that should be powered in the firing cycle. For example, the input 118 could indicate that 8, 16, 24, or 32 of the energizers 122 should be powered in a given sequence based upon receipt of a single fire signal 114.

Each fire signal selects and powers the next energizer 122 in the sequence. At the end of the cycle the firing sequence advances to the first energizer 122 in the cycle, and then continues again from there. In some embodiments the energizers 122 are resistive heating elements, and in some embodiments the energizers 122 are piezoelectric devices.

In some embodiments inputs 106, 112, 116, and 118 are set at default values, and no connection from the on-chip controller to any external controller is needed. In these embodiments, only three connections are made to the pump on the monolithic chip, which connections are the power 126, ground 128, and enable 108.

Basic Embodiment

FIGS. 2-5 depict more detailed depictions of the structural blocks of FIG. 1, and thus disclose one way to implement the features of the present invention.

Voltage Control Oscillator

Figure 2:
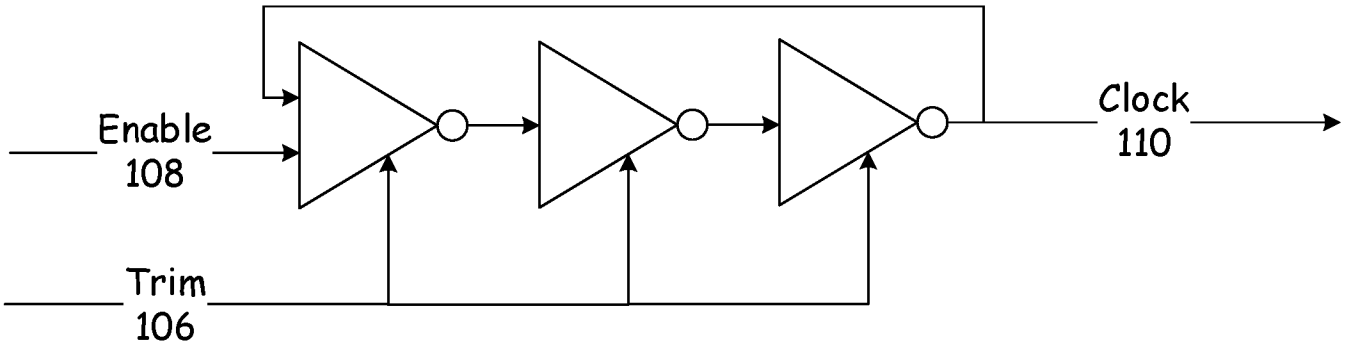
FIGS. 2-5 are logic diagrams for the control circuitry of a microfluidic pump according to an embodiment of the present invention.

FIG. 2 depicts the VCO 100 in greater detail. The topology depicted in FIG. 2 is a three inverter ring oscillator. The number of inverters may be increased, always using an odd number of inverters, to lower the frequency of the oscillator 100 to a desired value. The clock frequency is preset using a chip internal voltage, but can be over-driven with an external voltage 106. The enable signal 108 is a logic high to generate a logic high on the clock line 110. When the enable 108 is low, the clock output 110 is a logic low.

Fire Generator

Figure 3:
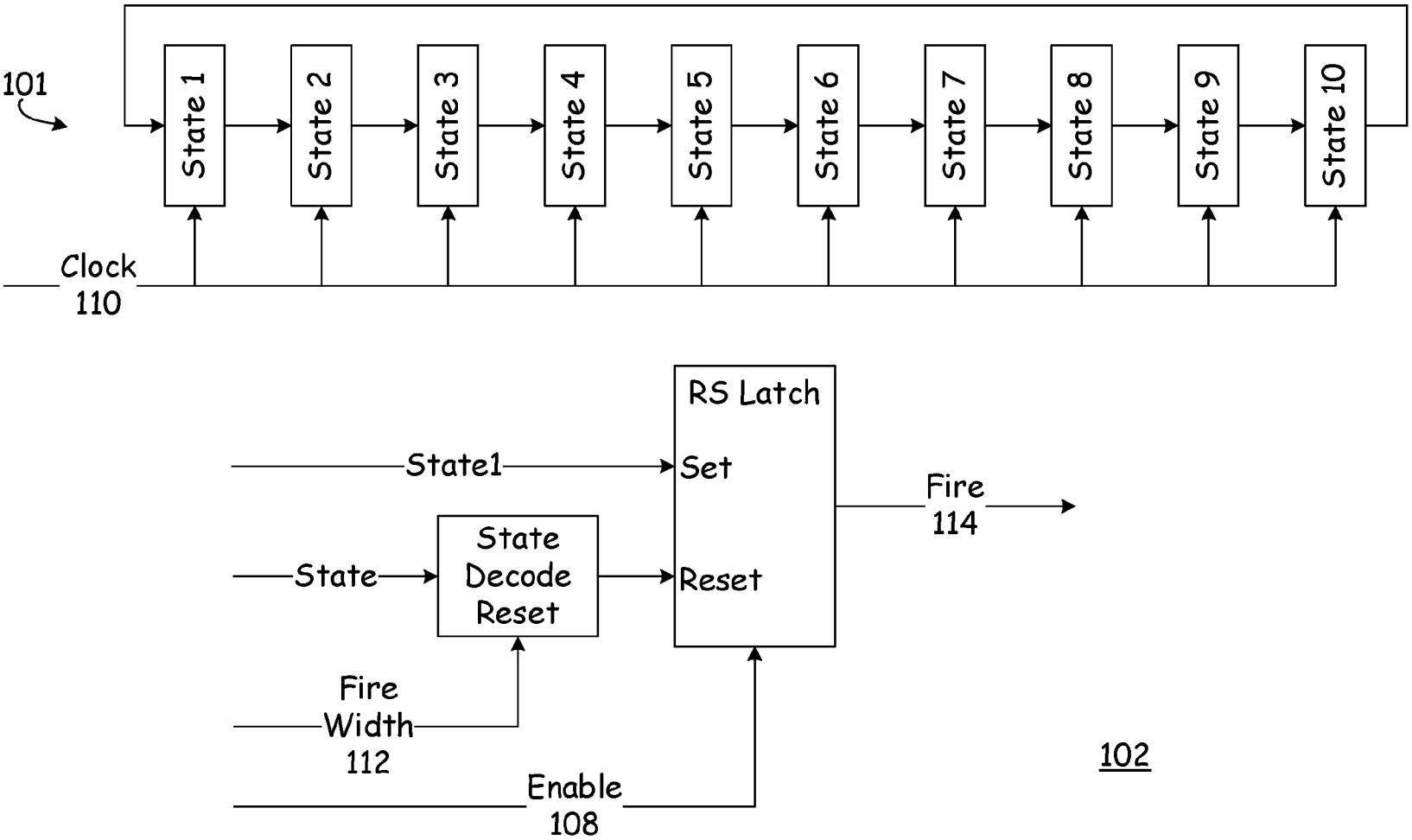

FIG. 3 depicts the fire generator 102 in greater detail. The fire generator 102 generates a fire signal 114 from its input clock 110. The fire signal 114 has a preset default pulse width that is suited for the pump actuators, though in some embodiments the preset value may be overridden, such as for experimental purposes. The core of the fire generation 102 is a ten state machine 101 that recycles every ten states when the enable signal 108 is a logic high. Each input clock rising transition advances the state machine 101 to the next state. When the enable 108 is a logic low, the fire signal 114 is low. In state 1 a reset-set latch is set and the fire signal 114 is a logic high. When the state of the machine matches the preset value, the RS latch is reset and the fire signal 114 now assumes a logic low level. In this manner, a repeating fire signal with a defined pulse width is present when the enable 108 is a logic high.

Pump Controller

Figure 4:
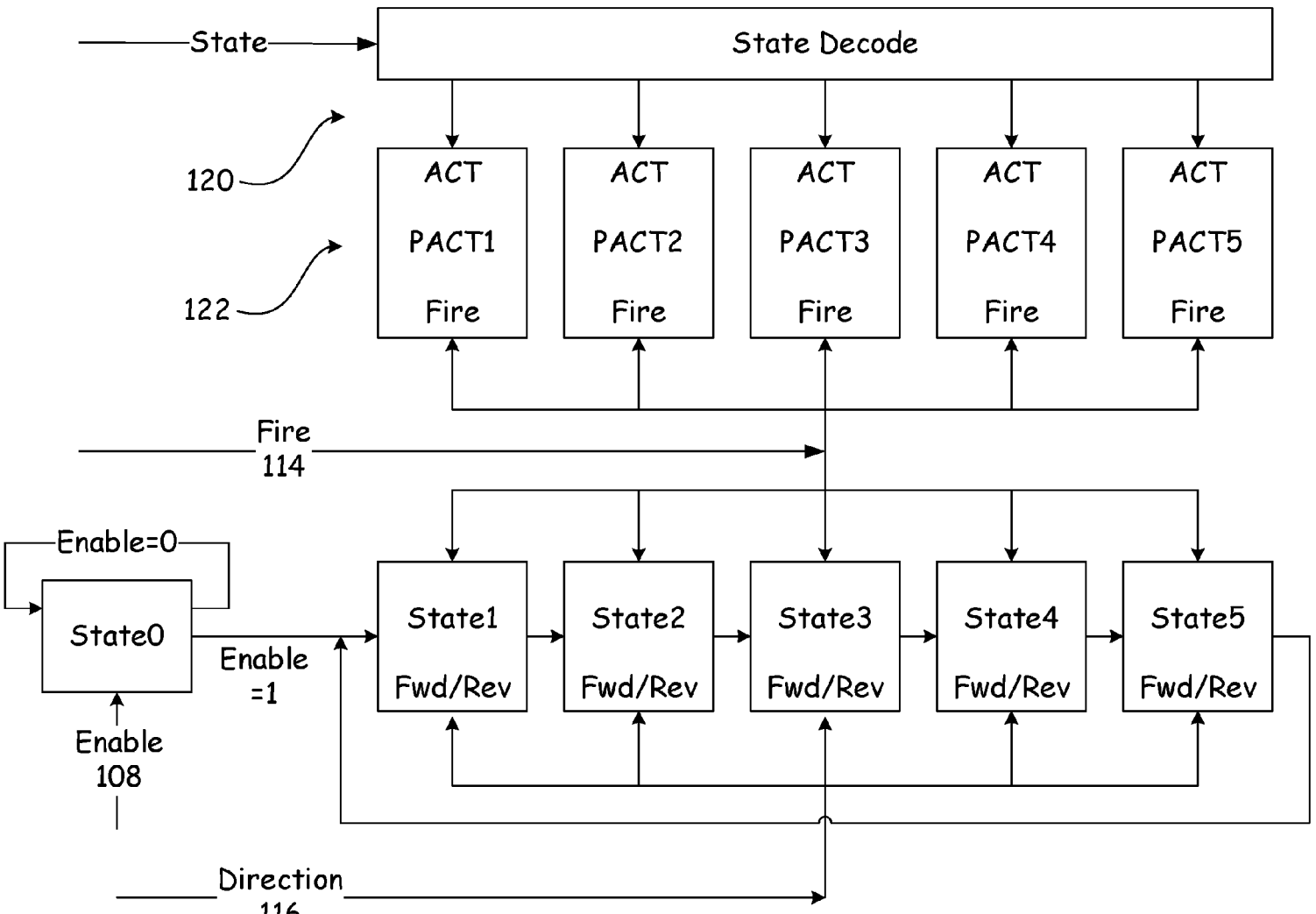

FIG. 4 depicts the self-cycling pump controller 104 in greater detail. The pump controller 104 is a state machine that is illustrated in FIG. 46 with five states, although any number may be used. The state machine advances when the input enable signal 108 is a logic high with the rising transition of the input fire signal 114. When enable 108 is a logic low, the state machine stays in state 0 and no actuators are selected. The state machine default is advance to the next state, however the default may be overridden using the forward/reverse logic signal 116 to reverse the state order. The state decode logic block determines which pump actuators are to be fired, using the ACT signal 120 for each pump actuator 122. One example of a state decoder is to set the ACT 120 to a logic high for one pump 122 for each state, and advance to the next adjacent pump 122 for the next state. The state order repeats while the enable signal 108 is logic high, and remains in state 0 when the enable signal 108 is low.

Pump Actuator

Figure 5:
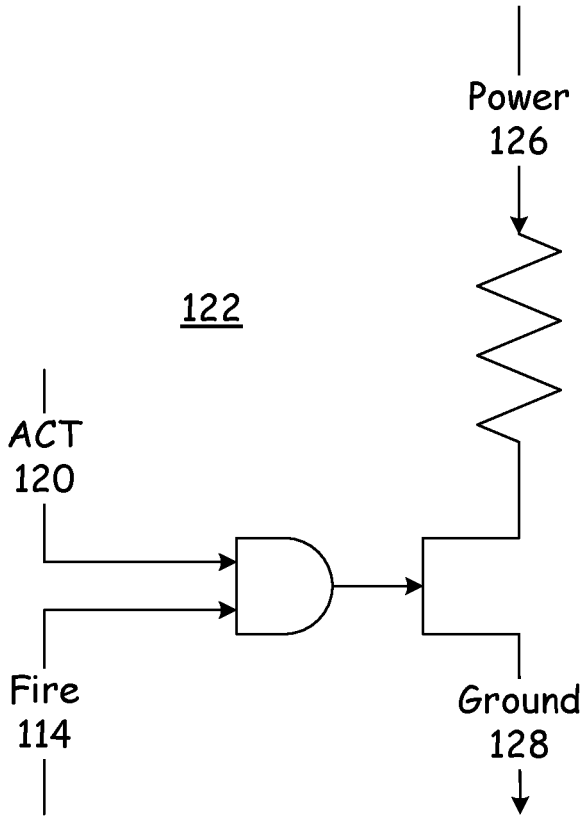

FIG. 5 depicts a pump actuator block in greater detail. The pump actuator block generates the driving signal for the pump actuator/heater. The block contains a logic AND and a MOS transistor switch to activate the pump heater. The HPWR signal is a voltage to set the correct pump heater current. When ACT is low the pump heater is deactivated. When the ACT signal is a logic high and the Fire signal is a logic high the MOS switch activates current through the heater. The current flows for the duration of the Fire signal and terminates when the Fire signal returns to a logic low. Therefore, the pump heater current flows for a time equal to the Fire input pulse width when the ACT signal is a logic high.

Thus, only three connections, power 126, ground 128, and enable 108, are required to start and stop the pump 10, which has a preset fire pulse width and pumping order suited for the pumping action.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A microfluidic pump, comprising
a monolithic chip,
a closed length of channel disposed on the chip, the channel having a first open end and a second open end,
a plurality of energizers disposed along the length of the channel, each energizer associated with a unique energizer designation,
an onboard controller disposed on the chip,
energizer fire control lines disposed on the chip, one each of the energizer fire control lines electrically connecting one each of the energizers to the onboard controller,
inputs electrically connected to the onboard controller, for connecting the onboard controller to an external controller that is not disposed on the chip, the inputs comprising
a power input,
an enable input,
a pump direction input, and
an energizer run length input,
the onboard controller having circuitry to,
receive from the external controller and selectively retain a pump direction on the pump direction input,
receive from the external controller and selectively retain an energizer run length on the energizer run length input,
receive from the external controller an enable on the enable input,
send a timed sequence of fire commands on the energizer fire control lines to a selected number of energizers that is equal to the energizer run length, starting with a stored starting energizer and ending with an ending energizer, and
update the stored starting energizer with the designation for the energizer next following the ending energizer.

2. The microfluidic pump of claim 1, wherein the energizers are heaters.

3. The microfluidic pump of claim 1, wherein the energizers are piezoelectric devices.

4. The microfluidic pump of claim 1, wherein the energizer run length is an integer between 1 and 32.

5. The microfluidic pump of claim 1, wherein the energizer run length is equal to 8x, where x is an integer from 1 to 4.

6. The microfluidic pump of claim 1, wherein the timed sequence comprises a set time between each fire command.

7. The microfluidic pump of claim 1, wherein the timed sequence comprises a variable time between each fire command.

8. The microfluidic pump of claim 1, wherein the timed sequence comprises a selectable time between each fire command.

9. A microfluidic pump, comprising
a monolithic chip,
a closed length of channel disposed on the chip, the channel having a first open end and a second open end,
a plurality of energizers disposed along the length of the channel, each energizer associated with a unique energizer designation,
an onboard controller disposed on the chip,
energizer fire control lines disposed on the chip, one each of the energizer fire control lines electrically connecting one each of the energizers to the onboard controller,
inputs electrically connected to the onboard controller, for connecting the onboard controller to an external controller that is not disposed on the chip, the inputs comprising
a power input,
a ground input, and
an enable input,
the onboard controller having circuitry to,
receive from the external controller an enable on the enable input,
send a timed sequence of fire commands on the energizer fire control lines to a selected number of energizers that is greater than one, starting with a stored starting energizer and ending with an ending energizer, and
update the stored starting energizer with the designation for the energizer next following the ending energizer.

10. The microfluidic pump of claim 9, wherein the energizers are heaters.

11. The microfluidic pump of claim 9, wherein the energizers are piezoelectric devices.

12. The microfluidic pump of claim 9, wherein the timed sequence comprises a set time between each fire command.

13. The microfluidic pump of claim 9, wherein the timed sequence comprises a variable time between each fire command.

14. The microfluidic pump of claim 9, wherein the timed sequence comprises a selectable time between each fire command.

15. A microfluidic pump, comprising
a monolithic chip,
a closed length of channel disposed on the chip, the channel having a first open end and a second open end,
a plurality of heaters disposed along the length of the channel, each heater associated with a unique heater designation,
an onboard controller disposed on the chip,
heater fire control lines disposed on the chip, one each of the heater fire control lines electrically connecting one each of the heaters to the onboard controller,
inputs electrically connected to the onboard controller, for connecting the onboard controller to an external controller that is not disposed on the chip, the inputs comprising
a power input,
an enable input,
a pump direction input, and
a heater run length input,
the onboard controller having circuitry to, receive from the external controller and selectively retain a pump direction on the pump direction input, receive from the external controller and selectively retain a heater run length on the heater run length input, wherein the energizer run length is equal to 8x, where x is an integer from 1 to 4, receive from the external controller an enable on the enable input, send a timed sequence of fire commands on the heater fire control lines to a selected number of heaters that is equal to the heater run length, starting with a stored starting heater and ending with an ending heater, and update the stored starting heater with the designation for the heater next following the ending heater.

16. The microfluidic pump of claim 15, wherein the timed sequence comprises a set time between each fire command.

17. The microfluidic pump of claim 15, wherein the timed sequence comprises a variable time between each fire command.

18. The microfluidic pump of claim 15, wherein the timed sequence comprises a selectable time between each fire command.

* * * * *